US009198491B2

(12) United States Patent
Chang et al.

(10) Patent No.: US 9,198,491 B2
(45) Date of Patent: Dec. 1, 2015

(54) ELECTRONIC DEVICE EQUIPPED WITH STYLUS STORAGE MECHANISM

(71) Applicant: Wistron Corporation, New Taipei (TW)

(72) Inventors: Te-Wei Chang, New Taipei (TW); Chia-Cheng Su, New Taipei (TW); Tsung-Hsien Chen, New Taipei (TW); Po-Yuan Hsu, New Taipei (TW); Hsing-Wang Chang, New Taipei (TW); Ping-Feng Liao, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 185 days.

(21) Appl. No.: 14/070,590

(22) Filed: Nov. 4, 2013

(65) Prior Publication Data

US 2014/0374296 A1 Dec. 25, 2014

(30) Foreign Application Priority Data

Jun. 19, 2013 (TW) ..... 102211436 A

(51) Int. Cl.
*A45C 11/34* (2006.01)
*A45F 5/10* (2006.01)
*A45C 13/28* (2006.01)

(52) U.S. Cl.
CPC . *A45C 11/34* (2013.01); *A45F 5/10* (2013.01); *A45C 13/28* (2013.01); *A45F 2200/0525* (2013.01)

(58) Field of Classification Search
CPC ..... A45C 2011/002; A45C 2011/003; A45C 11/34; A45C 2013/025; A45C 13/001; G06F 1/1607; G06F 1/1628; G06F 3/033; H04M 1/026
USPC ..... 206/320, 37, 371; 178/19.01; 345/179
See application file for complete search history.

(56) References Cited

U.S. PATENT DOCUMENTS

| | | | | |
|---|---|---|---|---|
| 7,380,655 | B1 * | 6/2008 | Thune et al. | 206/214 |
| 8,493,368 | B2 * | 7/2013 | Hsieh et al. | 345/179 |
| 2002/0060098 | A1 * | 5/2002 | Liu et al. | 178/19.01 |
| 2004/0042168 | A1 * | 3/2004 | Yang et al. | 361/685 |
| 2006/0257196 | A1 * | 11/2006 | Liu et al. | 401/88 |
| 2010/0231557 | A1 * | 9/2010 | Wang | 345/179 |
| 2010/0302213 | A1 * | 12/2010 | Yeh | 345/179 |
| 2011/0188184 | A1 | 8/2011 | Hsu | |
| 2011/0310065 | A1 * | 12/2011 | Liang | 345/179 |
| 2012/0018336 | A1 * | 1/2012 | Liu et al. | 206/488 |
| 2013/0021729 | A1 * | 1/2013 | Su | 361/679.01 |
| 2013/0070397 | A1 * | 3/2013 | Xie | 361/679.01 |

* cited by examiner

*Primary Examiner* — Anthony Stashick
*Assistant Examiner* — Robert Poon
(74) *Attorney, Agent, or Firm* — Winston Hsu; Scott Margo

(57) ABSTRACT

A stylus storage mechanism includes a casing, a rotating member, a torsion spring, a sleeve assembly and a resilient member. The casing has an accommodating space, a first end and a second end, wherein the first end communicates with the second end via the accommodating space. The rotating member has an operating portion and a protruding portion. An end of the rotating member is inserted into the accommodating space from the first end, wherein the operating portion is exposed out of the first end and the protruding portion is located in the accommodating space. The torsion springs is disposed in the accommodating space. Opposite ends of the torsion spring are connected to the rotating member and the casing. The sleeve assembly is disposed in the accommodating space and has an oblique guiding portion and a fixing hole. The resilient member is disposed between the sleeve assembly and the rotating member.

17 Claims, 11 Drawing Sheets

ELECTRONIC DEVICE EQUIPPED WITH STYLUS STORAGE MECHANISM

BACKGROUND OF THE INVENTION

1. Field of the Invention

The invention relates to an electronic device and a stylus storage mechanism thereof and, more particularly, to a stylus storage mechanism capable of accommodating and ejecting a stylus conveniently and stably.

2. Description of the Prior Art

Since consumer electronic products have become more and more lighter, thinner, shorter, and smaller, there is no space on these products for containing a conventional input device, such as a mouse, a keyboard, etc. With development of touch technology, in various kinds of consumer electronic products (e.g. display device, all-in-one machine, mobile phone, personal digital assistant (PDA), tablet computer, notebook computer, etc.), a touch device has become a main tool for data input. To enable a user to perform touch operation more conveniently, an electronic device with a touch screen is usually equipped with a stylus and the stylus is accommodated in a case body of the electronic device. When the user wants to perform touch operation on the screen, he/she can take the stylus out and use the stylus to touch the screen. Therefore, how to accommodate and eject the stylus conveniently and stably has become a significant design issue for a stylus storage mechanism.

SUMMARY OF THE INVENTION

The invention provides an electronic device and a stylus storage mechanism thereof and, more particularly, to a stylus storage mechanism capable of accommodating and ejecting a stylus conveniently and stably.

According to the claimed invention, a stylus storage mechanism comprises a casing, a rotating member, a torsion spring, a sleeve assembly and a resilient member. The casing has an accommodating space, a first end and a second end, wherein the first end is opposite to the second end, and the first end communicates with the second end via the accommodating space. The rotating member has an operating portion and a protruding portion, wherein an end of the rotating member is inserted into the accommodating space from the first end, the operating portion is exposed out of the first end, and the protruding portion is located in the accommodating space. The torsion spring is disposed in the accommodating space, wherein opposite ends of the torsion spring are connected to the rotating member and the casing. The sleeve assembly is disposed in the accommodating space, the sleeve assembly has an oblique guiding portion and a fixing hole, and the oblique guiding portion is corresponding to the protruding portion. The resilient member is disposed between the sleeve assembly and the rotating member. When a stylus is inserted into the accommodating space from the second end and pushes the sleeve assembly to move toward the rotating member, an end of the stylus is fixed in the fixing hole and the oblique guiding portion pushes the protruding portion, such that the rotating member rotates in a first direction. When the oblique guiding portion moves over the protruding portion, the torsion spring generates a torsion force for driving the rotating member to rotate in a second direction, such that the oblique guiding portion abuts against the protruding portion, wherein the first direction is opposite to the second direction. When the operating portion is rotated to drive the rotating member to rotate in the first direction and then the protruding portion is separated from the oblique guiding portion, the resilient member generates an elastic force for pushing the sleeve assembly to move away from the rotating member, so as to eject the stylus out of the accommodating space from the second end.

According to the claimed invention, the sleeve assembly comprises a first linking sleeve, a second linking sleeve and a fixing sleeve, the second linking sleeve is fixed on the first linking sleeve, the fixing sleeve is fixed on the second linking sleeve, the oblique guiding portion is formed in the first linking sleeve, and the fixing hole is formed on the fixing sleeve.

According to the claimed invention, the second linking sleeve has a pillar portion, the pillar portion is extended into the first linking sleeve, and the resilient member is sleeved on the pillar portion.

According to the claimed invention, the fixing sleeve is made of rubber.

According to the claimed invention, the first linking sleeve has an engaging hole, the second linking sleeve has an engaging hook, and the engaging hook is engaged in the engaging hole.

According to the claimed invention, the first linking sleeve has a restraining portion, a restraining groove is formed in the accommodating space, and the restraining portion is located in the restraining groove, so as to restrain the sleeve assembly from rotating with respect to the casing.

According to the claimed invention, the fixing sleeve has a plurality of protruding blocks protruding from a periphery of the fixing hole inwardly and used for fixing the end of the stylus in the fixing hole in a tight-fitting manner.

According to the claimed invention, the casing has a first stop portion, the rotating member has a second stop portion, and the first stop portion cooperates with the second stop portion to allow the rotating member to rotate in the first direction only when the stylus is accommodated in the accommodating space.

According to the claimed invention, an electronic device comprises a main device and the aforesaid stylus storage mechanism. The stylus storage mechanism is disposed in a part of the main device.

According to the claimed invention, the part is a handle.

As mentioned in the above, when a user wants to store the stylus in the stylus storage mechanism, he/she can insert the stylus into the accommodating space of the casing and push the stylus to move toward the rotating member. At this time, an end of the stylus is fixed in the fixing hole of the sleeve assembly and the protruding portion on the rotating member cooperates with the oblique guiding portion in the sleeve assembly, such that the stylus can be accommodated in the stylus storage mechanism of the invention stably. Therefore, the stylus will not come off the stylus storage mechanism easily due to collision. Furthermore, when the user wants to take the stylus out, he/she only has to rotate the operating portion of the rotating member to separate the protruding portion on the rotating member from the oblique guiding portion in the sleeve assembly. Afterward, the resilient member generates an elastic force for pushing the sleeve assembly to move away from the rotating member, so as to eject the stylus out of the accommodating space of the casing. Accordingly, the user can take the stylus out of the stylus storage mechanism of the invention conveniently. Moreover, if the electronic device has a handle, the stylus storage mechanism of the invention may be disposed in the handle, so it will not occupy any space within a case body of the main device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
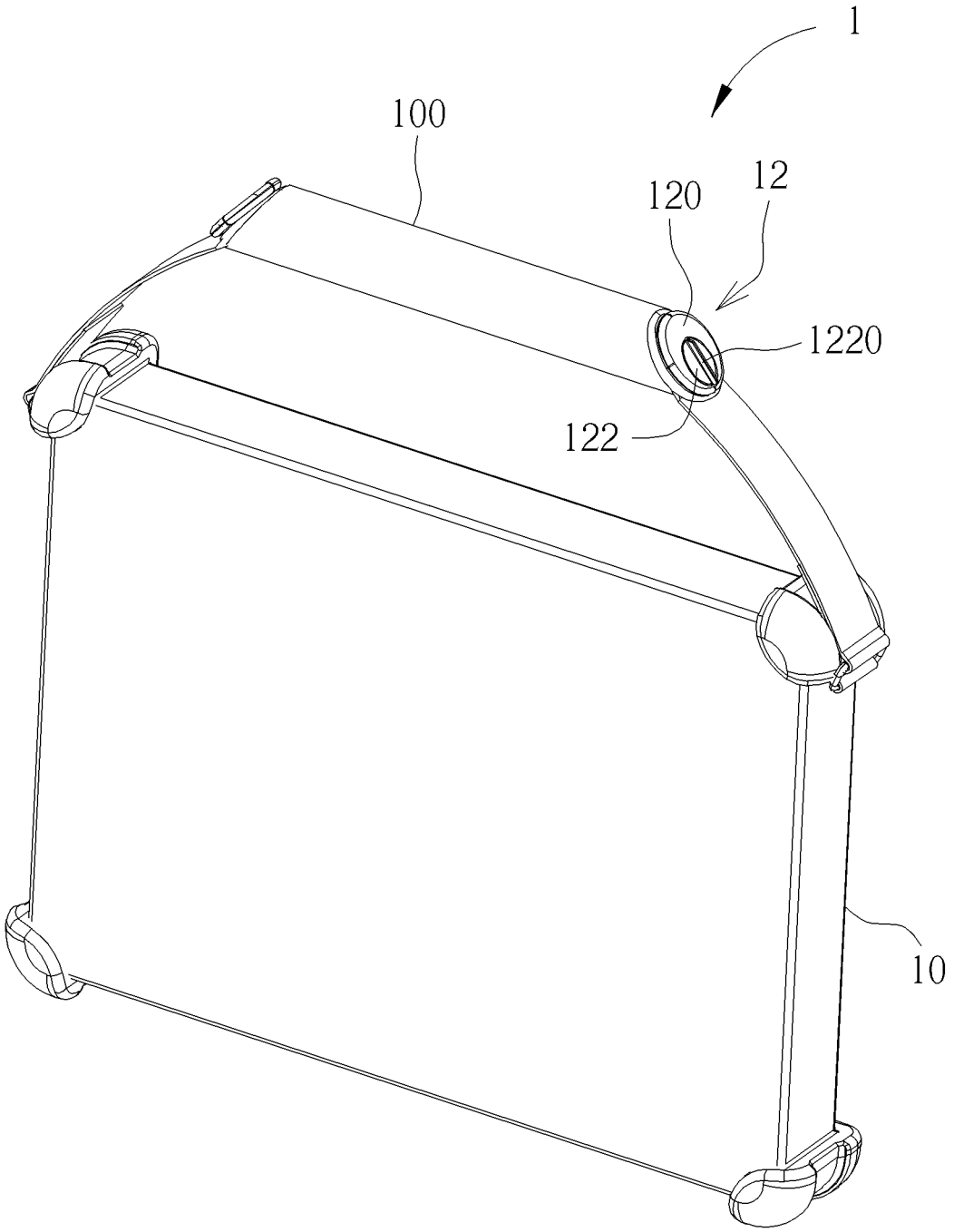
FIG. 1 is a perspective view illustrating an electronic device according to an embodiment of the invention.
Figure 2:
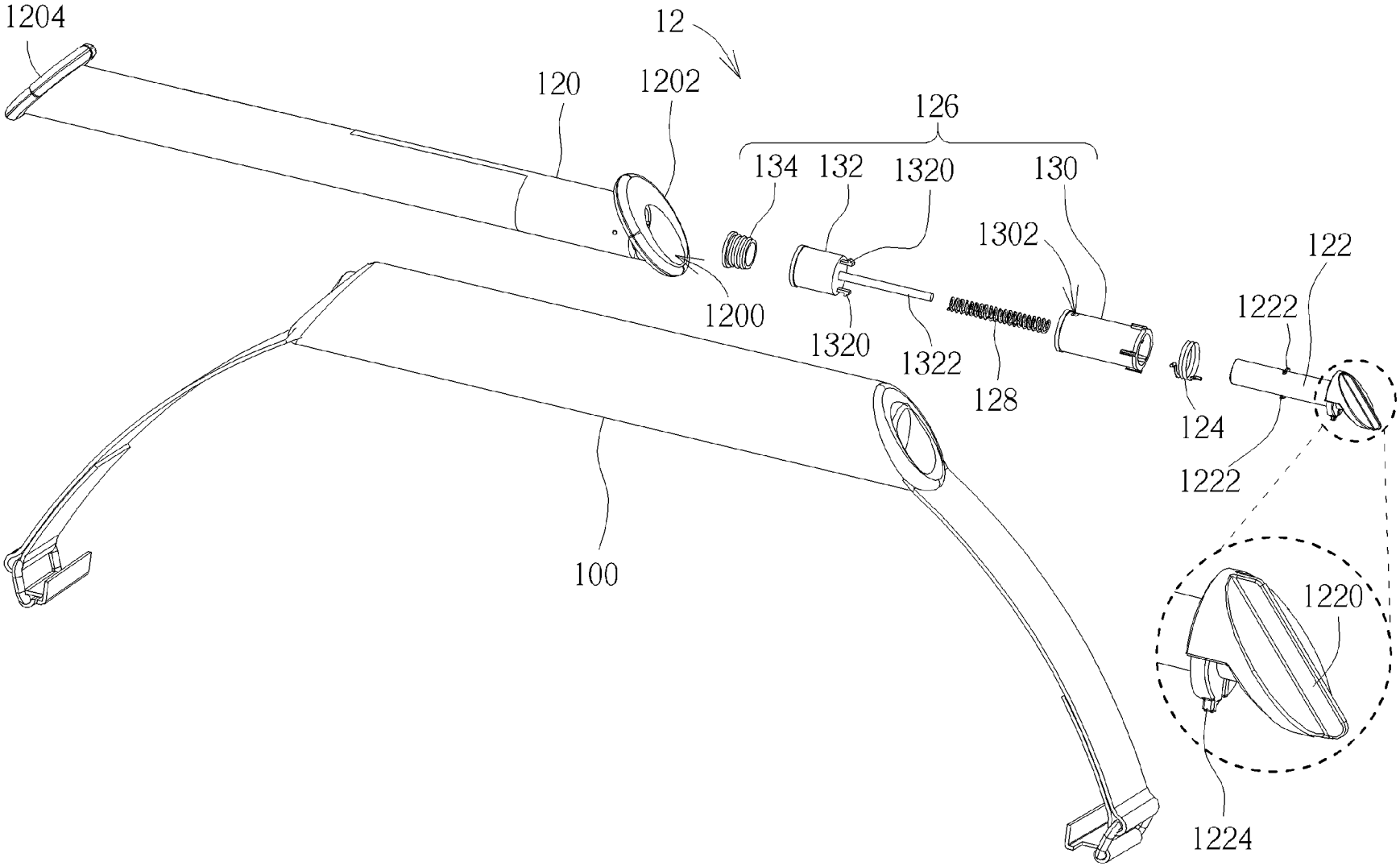
FIG. 2 is an exploded view illustrating the handle and the stylus storage mechanism shown in FIG. 1.
Figure 3:
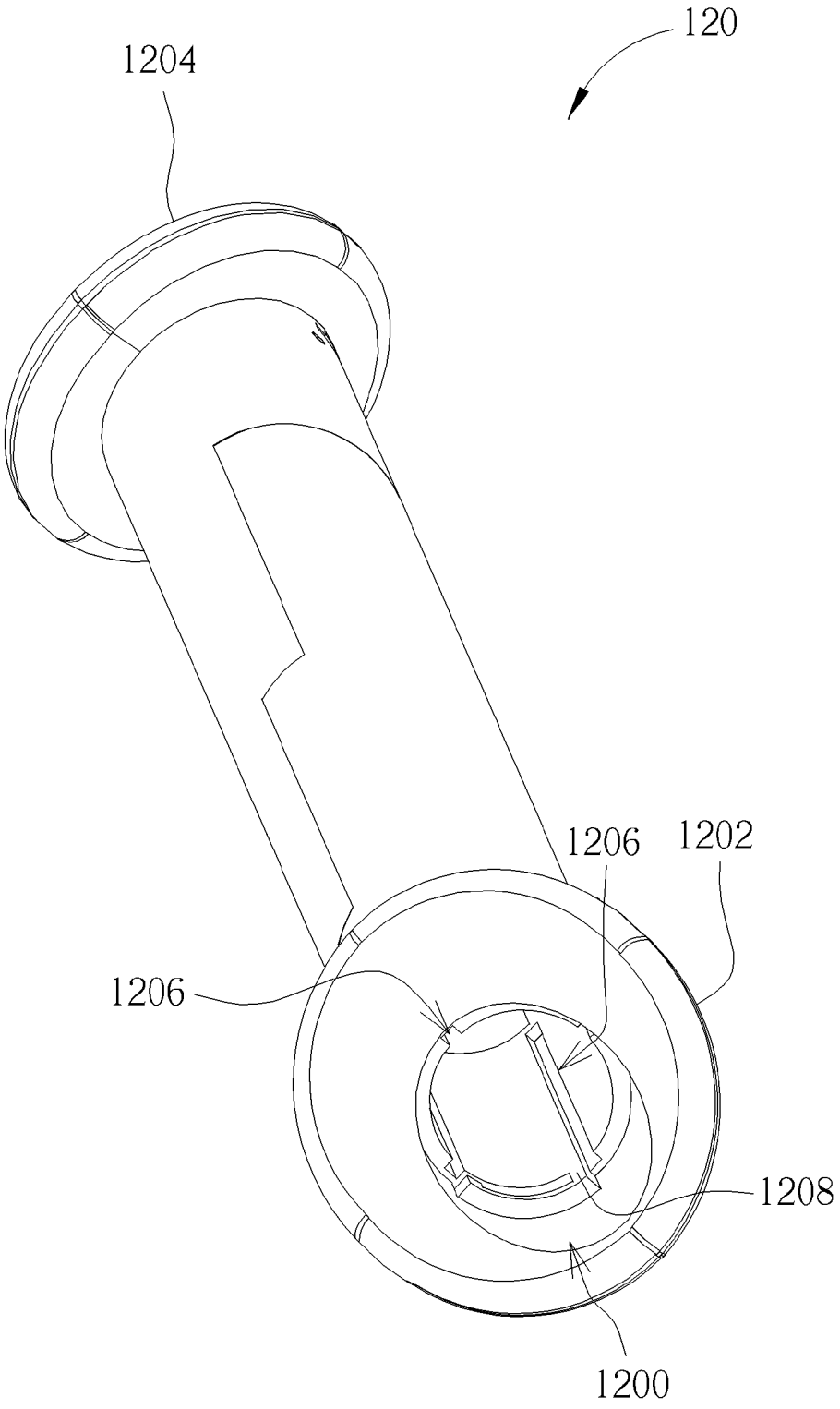
FIG. 3 is a perspective view illustrating the casing shown in FIG. 2 in another viewing angle.
Figure 4:
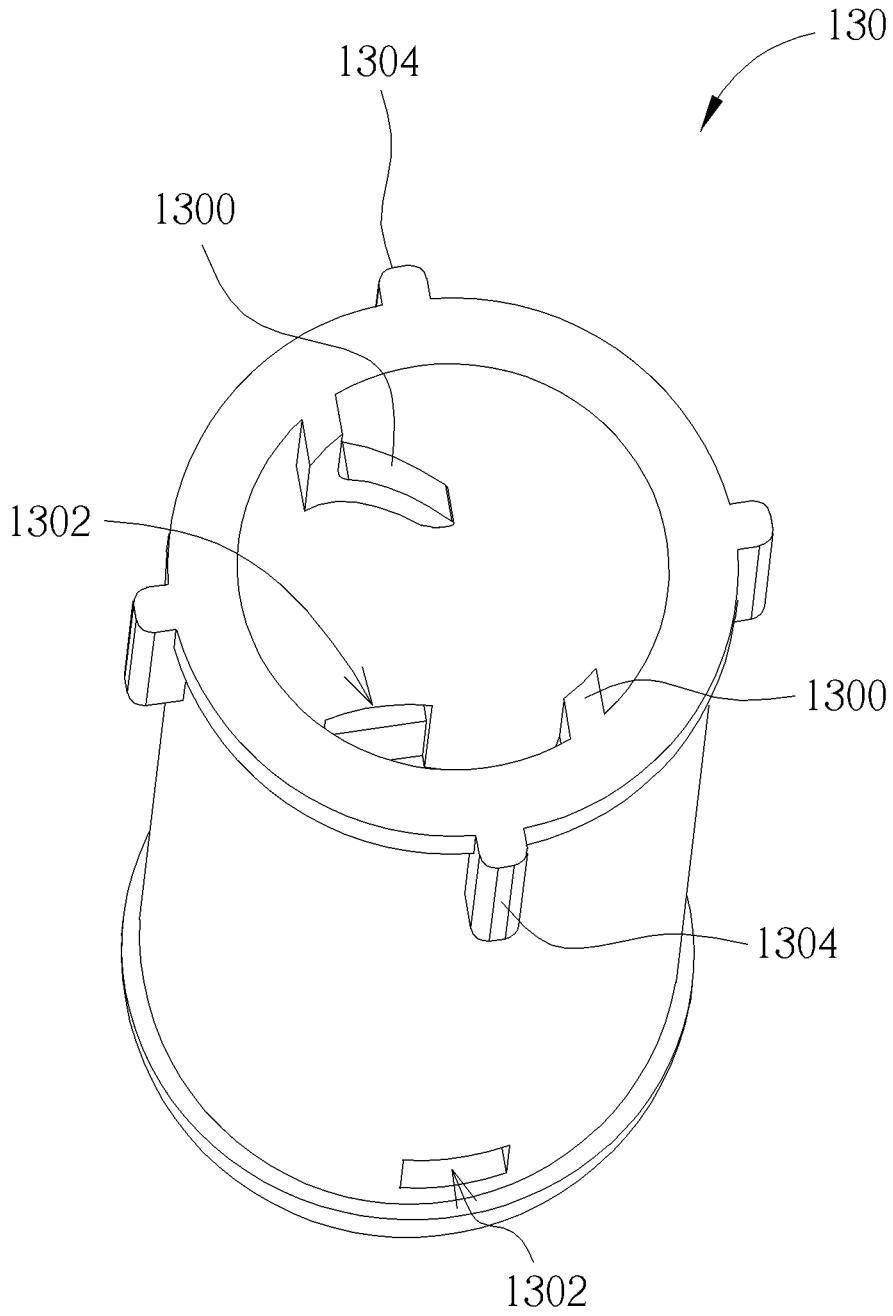
FIG. 4 is a perspective view illustrating the first linking sleeve shown in FIG. 2 in another viewing angle.
Figure 5:
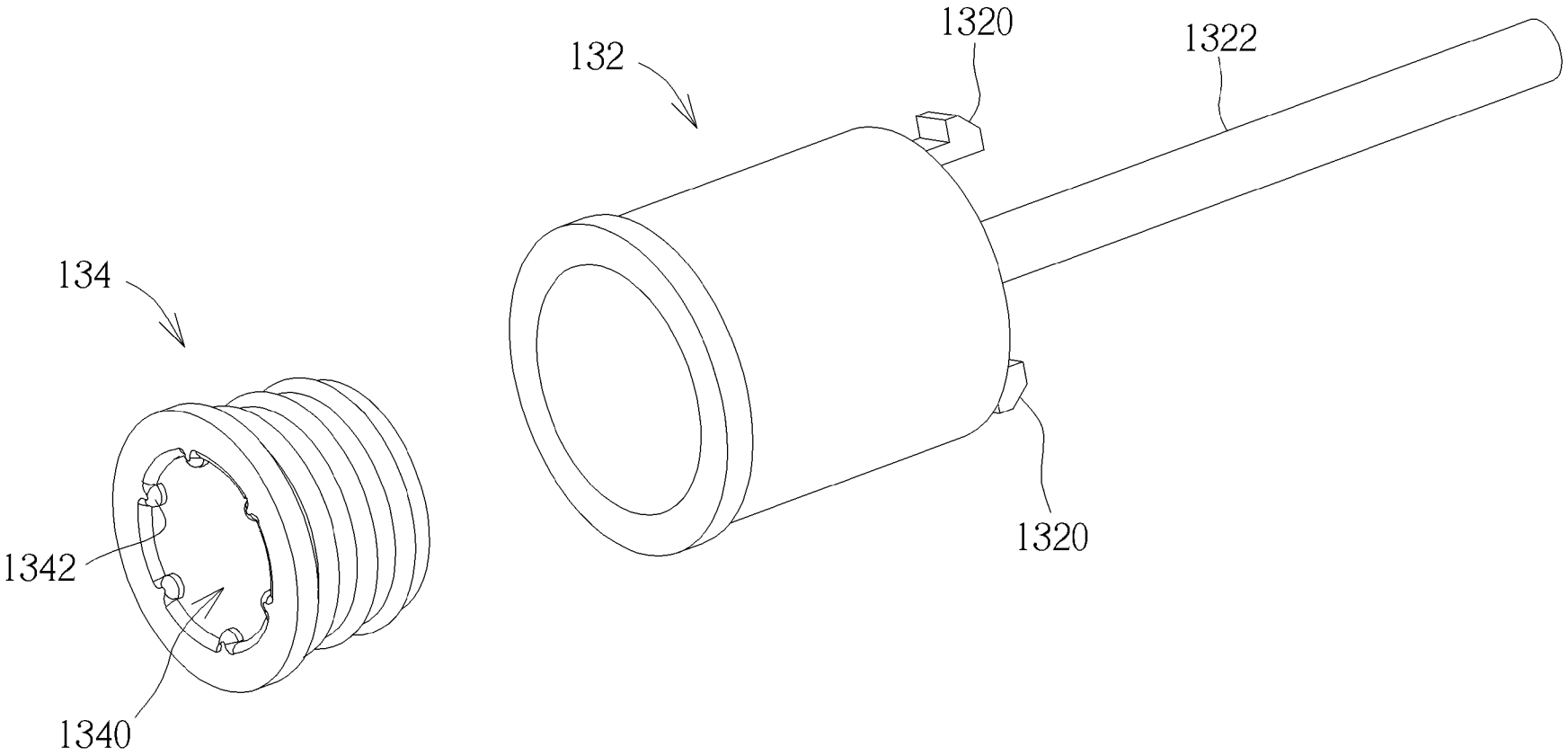
FIG. 5 is a perspective view illustrating the second linking sleeve and the fixing sleeve shown in FIG. 2 in another viewing angle.
Figure 6:
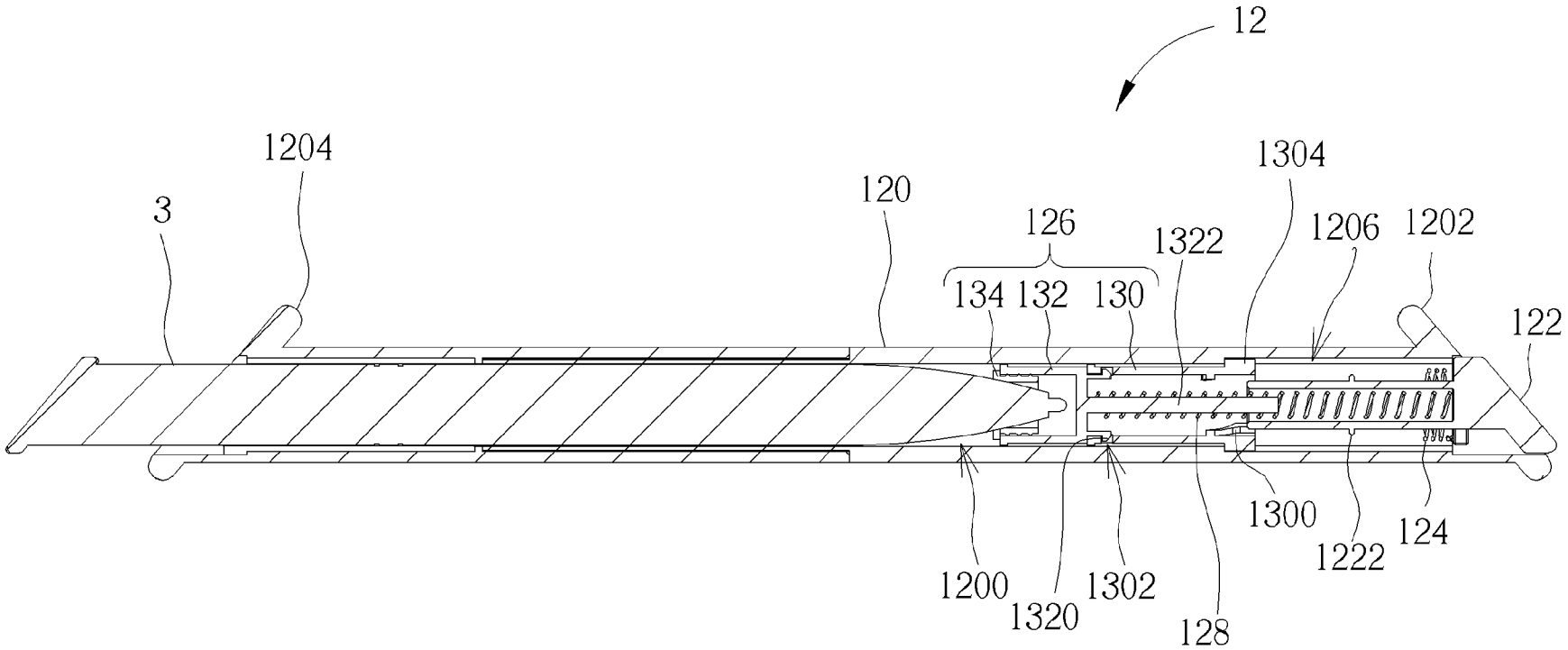
FIGS. 6 to 8 are cross-sectional views illustrating a process of inserting a stylus into the stylus storage mechanism.
Figure 7:
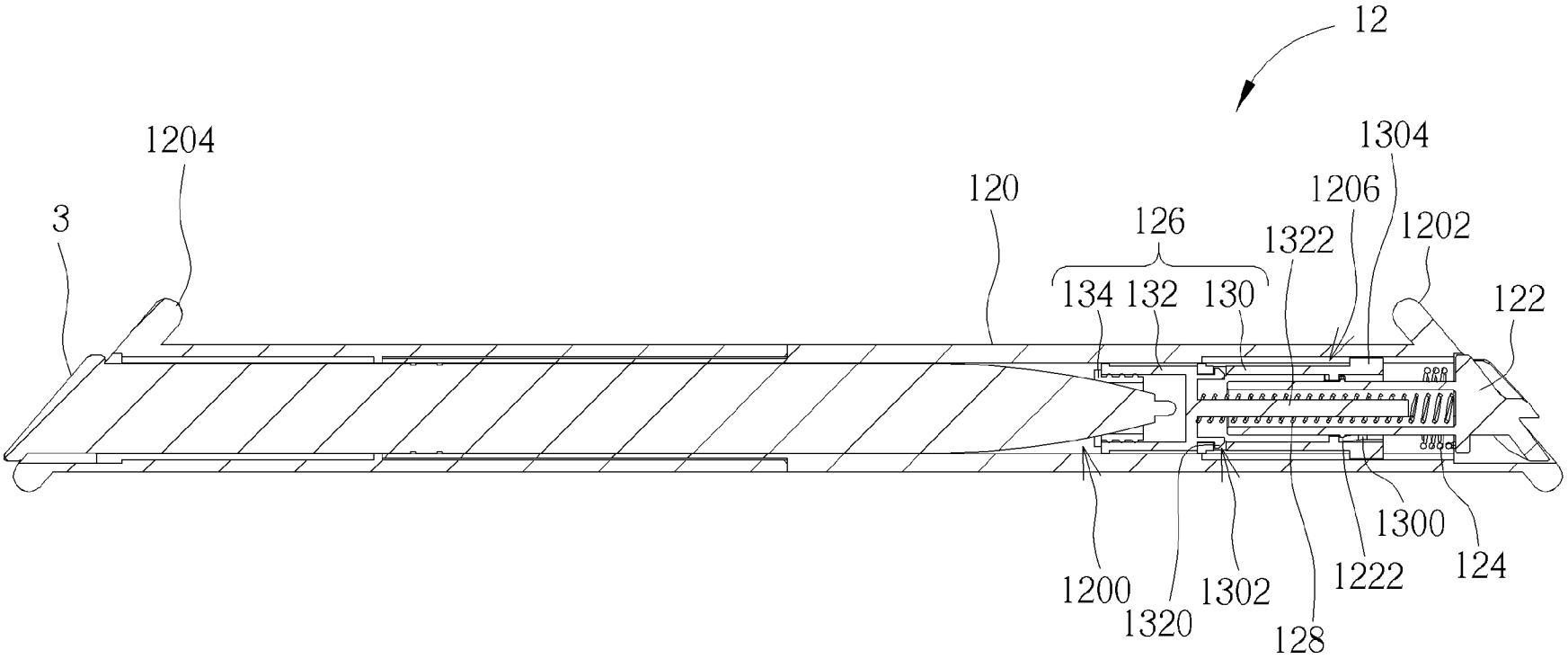
Figure 8:
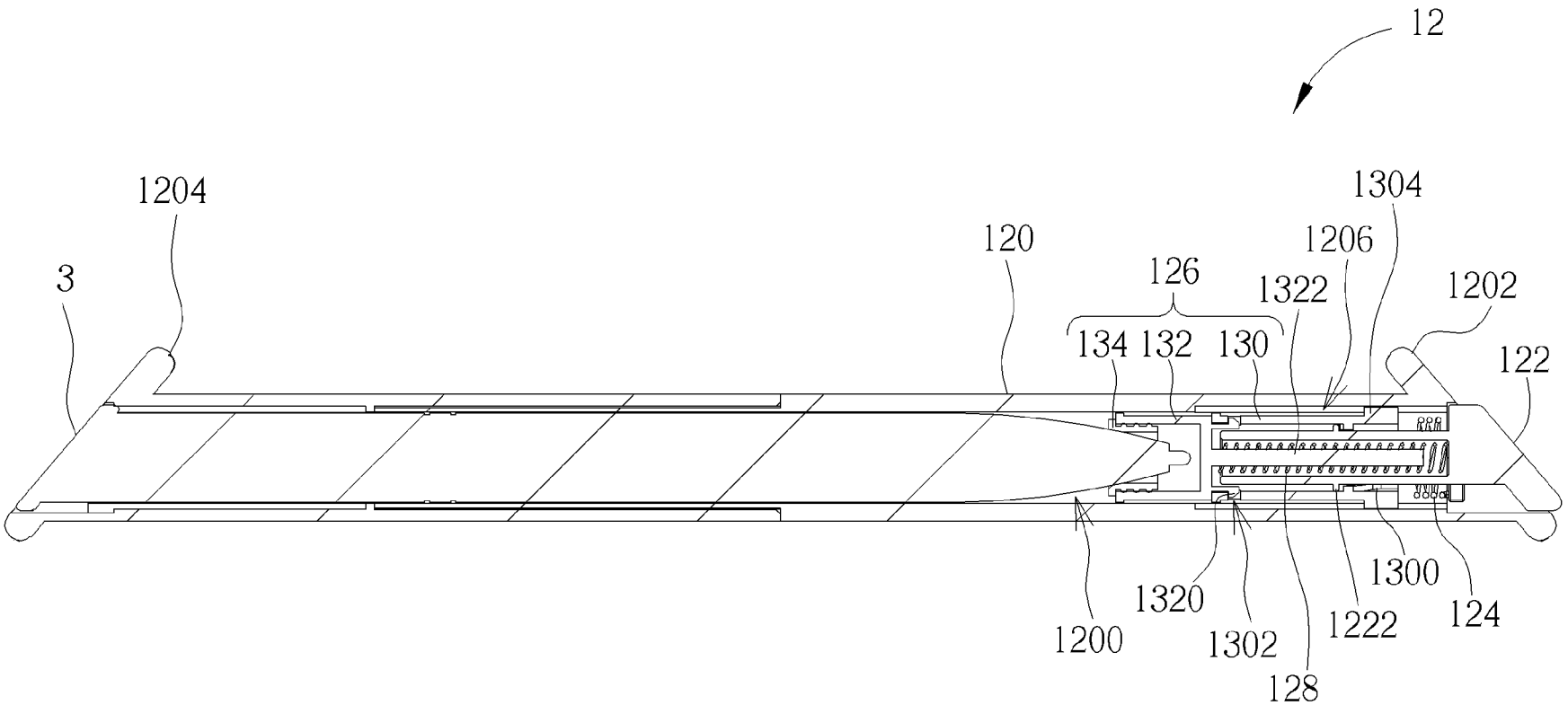
Figure 9:
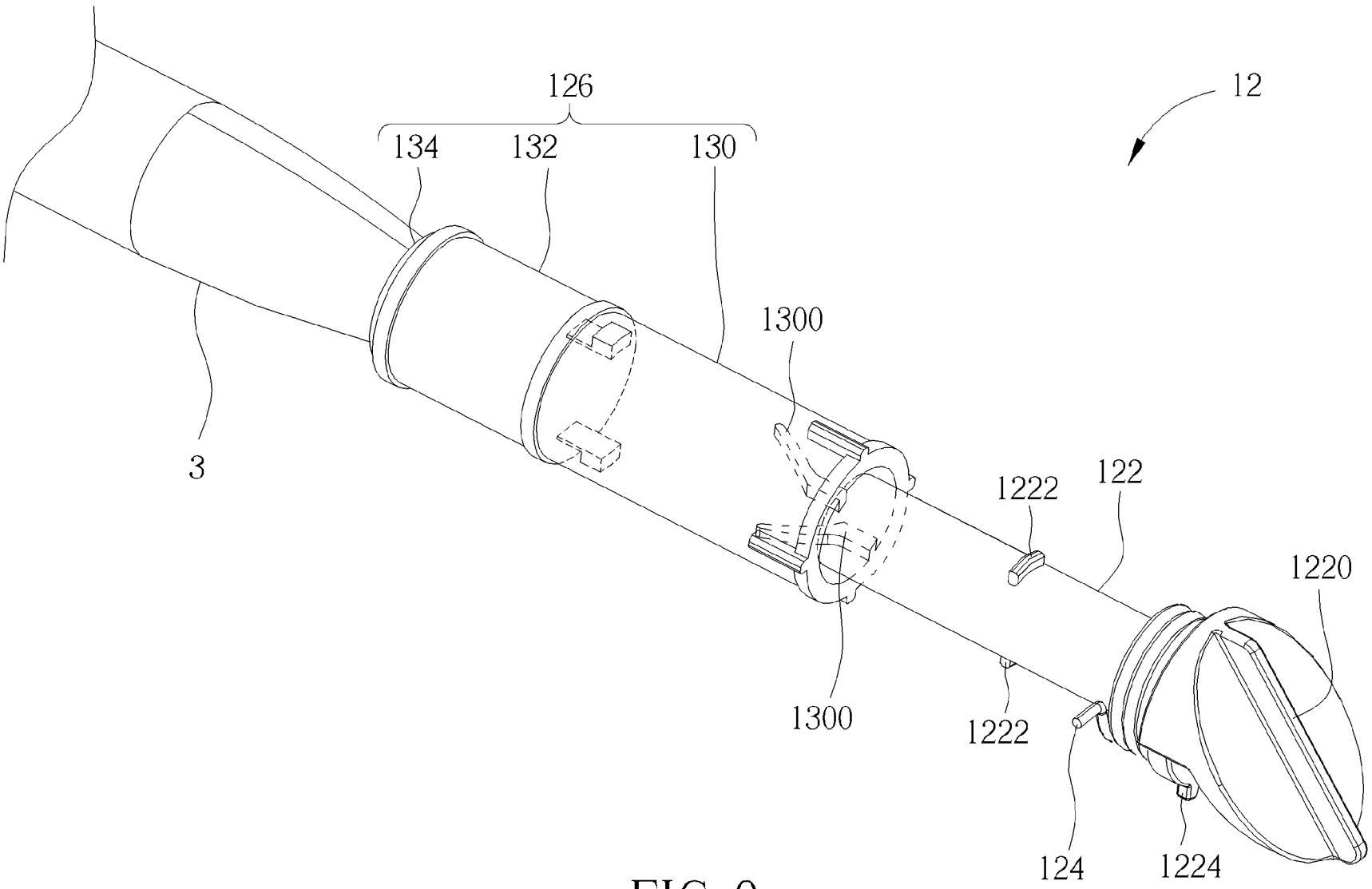
FIGS. 9 to 11 are perspective views illustrating the process of inserting the stylus into the stylus storage mechanism.
Figure 10:
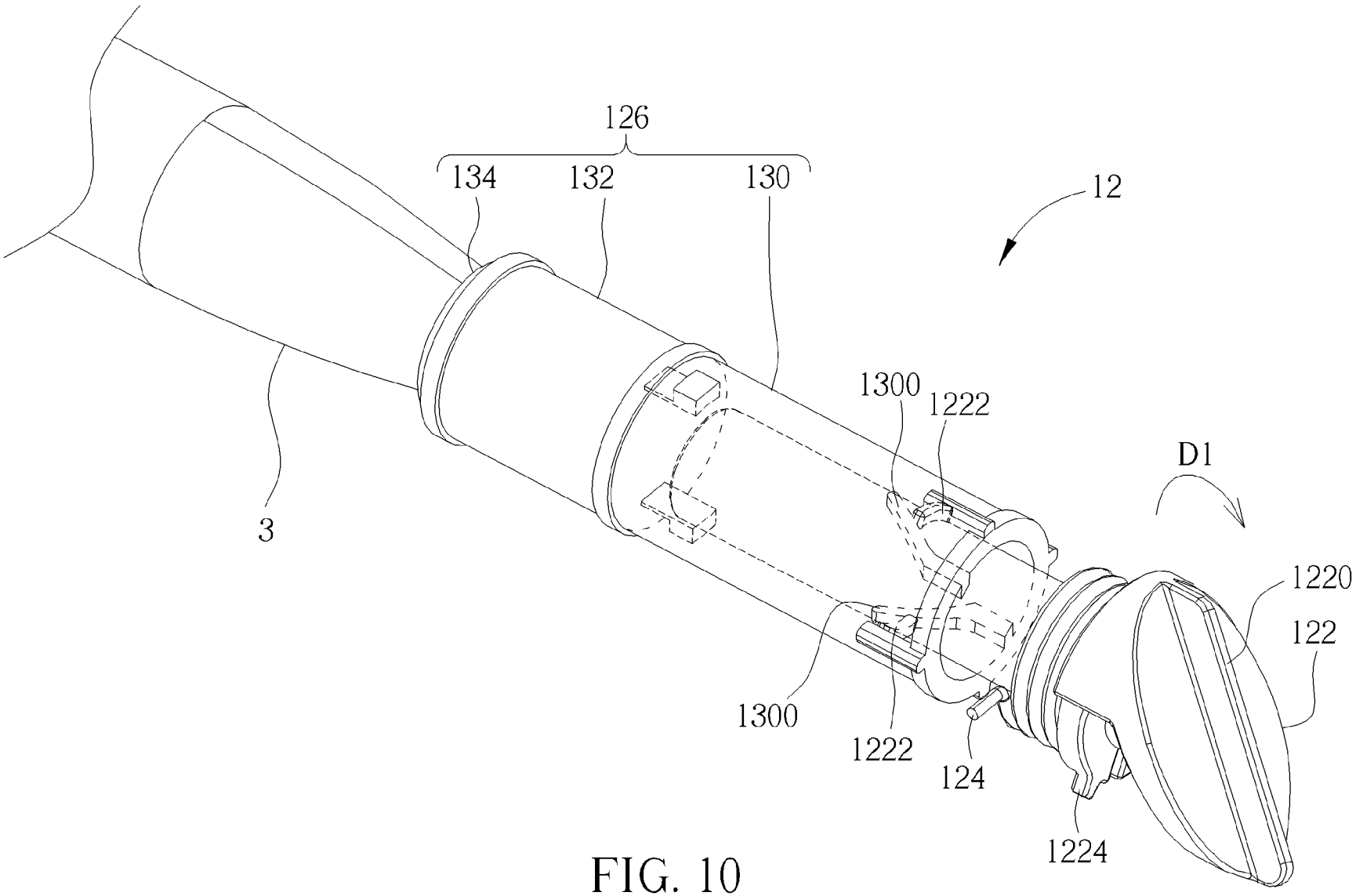
Figure 11:
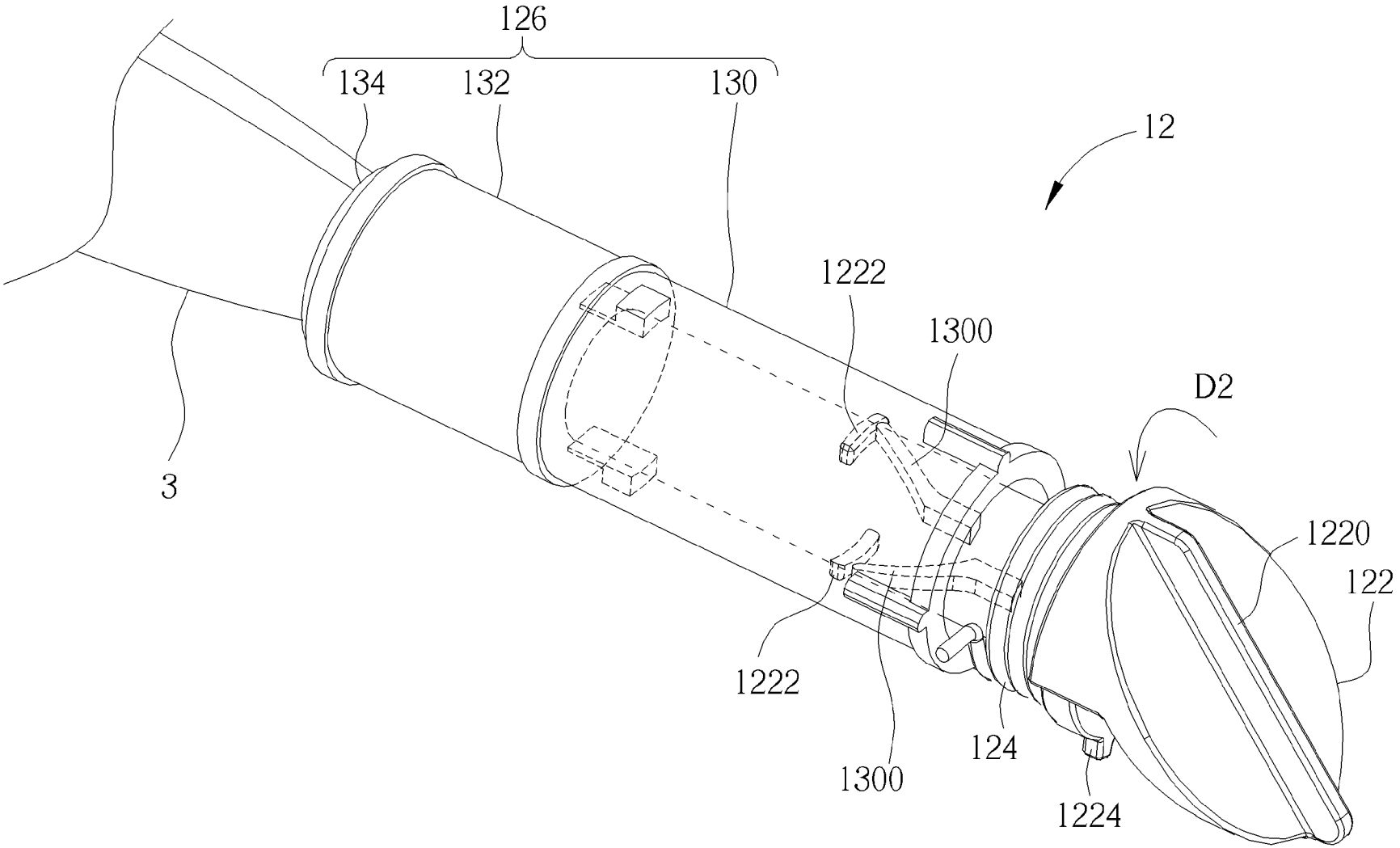

Referring to FIGS. 1 to 11, FIG. 1 is a perspective view illustrating an electronic device 1 according to an embodiment of the invention, FIG. 2 is an exploded view illustrating the handle 100 and the stylus storage mechanism 12 shown in FIG. 1, FIG. 3 is a perspective view illustrating the casing 120 shown in FIG. 2 in another viewing angle, FIG. 4 is a perspective view illustrating the first linking sleeve 130 shown in FIG. 2 in another viewing angle, FIG. 5 is a perspective view illustrating the second linking sleeve 132 and the fixing sleeve 134 shown in FIG. 2 in another viewing angle, FIGS. 6 to 8 are cross-sectional views illustrating a process of inserting a stylus 3 into the stylus storage mechanism 12, and FIGS. 9 to 11 are perspective views illustrating the process of inserting the stylus 3 into the stylus storage mechanism 12.

As shown in FIG. 1, the electronic device 1 comprises a main device 10 and a stylus storage mechanism 12. The main device 10 may be a display device, an all-in-one machine, a mobile phone, a personal digital assistant (PDA), a tablet computer, a notebook computer, or other electronic devices equipped with a touch panel. In this embodiment, the main device 10 has a handle 100 and the stylus storage mechanism 12 is disposed in the handle 100. However, in another embodiment, the stylus storage mechanism 12 may be also disposed in other parts of the main device 10, such as a case body of the main device 10. In other words, the stylus storage mechanism 12 may be disposed in any parts of the main device 10 and is not limited to be disposed in the handle 100. If the stylus storage mechanism 12 is disposed in the handle 100, it will not occupy any space within the case body of the main device 10.

As shown in FIGS. 2 and 6, the stylus storage mechanism 12 comprises a casing 120, a rotating member 122, a torsion spring 124, a sleeve assembly 126 and a resilient member 128. The casing 120 has an accommodating space 1200, a first end 1202 and a second end 1204, wherein the first end 1202 is opposite to the second end 1204, and the first end 1202 communicates with the second end 1204 via the accommodating space 1200. The rotating member 122 has an operating portion 1220 and two protruding portions 1222, wherein the two protruding portions 1222 protrude from a periphery of the rotating member 122. An end of the rotating member 122 is inserted into the accommodating space 1200 from the first end 1202 of the casing 120, wherein the operating portion 1220 is exposed out of the first end 1202 and the protruding portion 1222 is located in the accommodating space 1200. The torsion spring 124 is disposed in the accommodating space 1200 and opposite ends of the torsion spring 124 are connected to the rotating member 122 and an inner wall of the casing 120.

The sleeve assembly 126 is disposed in the accommodating space 1200 of the casing 120. In this embodiment, the sleeve assembly 126 comprises a first linking sleeve 130, a second linking sleeve 132 and a fixing sleeve 134, wherein the second linking sleeve 132 is fixed on the first linking sleeve 130 and the fixing sleeve 134 is fixed on the second linking sleeve 132. As shown in FIG. 4, two oblique guiding portions 1300 are formed in the first linking sleeve 130 and corresponding to the two protruding portions 1222 of the rotating member 122. The first linking sleeve 130 has two engaging holes 1302 and the second linking sleeve 132 has two engaging hooks 1320. The engaging hook 1320 can be engaged in the engaging hole 1302, so as to fix the second linking sleeve 132 on the first linking sleeve 130. The fixing sleeve 134 is made of, but not limited to, rubber. The fixing sleeve 134 may be fixed on the second linking sleeve 132 in a tight-fitting manner. As shown in FIG. 5, a fixing hole 1340 is formed on the fixing sleeve 134 and the fixing sleeve 134 has a plurality of protruding blocks 1342, wherein the protruding blocks 1342 protrude from a periphery of the fixing hole 1340 inwardly and are used for fixing an end of the stylus 3 in the fixing hole 1340 in a tight-fitting manner.

As shown in FIGS. 3 and 4, the first linking sleeve 130 further has four restraining portions 1304 and four restraining grooves 1206 are formed in the accommodating space 1200 of the casing 120. When the first linking sleeve 130 is disposed in the accommodating space 1200 of the casing 120, the restraining portion 1304 is located in the restraining groove 1206, so as to restrain the sleeve assembly 126 from rotating with respect to the casing 120.

The resilient member 128 is disposed between the sleeve assembly 126 and the rotating member 122. In this embodiment, the second linking sleeve 132 has a pillar portion 1322, wherein the pillar portion 1322 is extended into the first linking sleeve 130 and the resilient member 128 is sleeved on the pillar portion 1322. In this embodiment, the resilient member 128 may be, but not limited to, a compression spring.

It should be noted that the first linking sleeve 130, the second linking sleeve 132 and the fixing sleeve 134 may be also formed integrally to a single-piece sleeve assembly 126. Therefore, the single-piece sleeve assembly 126 has the aforesaid oblique guiding portions 1300, fixing hole 1340 and pillar portion 1322.

As shown in FIGS. 6 to 11, when a user wants to store the stylus 3 in the stylus storage mechanism 12, he/she can insert the stylus 3 into the accommodating space 1200 from the second end 1204 of the casing 120 and push the stylus 3 to move toward the rotating member 122. When the stylus 3 is inserted into the accommodating space 1200 from the second end 1204 of the casing 120 and pushes the sleeve assembly 126 to move toward the rotating member 122, an end of the stylus 3 is fixed in the fixing hole 1340 of the fixing sleeve 134 and the protruding portion 1222 of the rotating member 122 is pushed by the oblique guiding portion 1300 of the first linking sleeve 130, such that the rotating member 122 rotates in a first direction D1, as shown in FIG. 10. At this time, the torsion spring 124 is twisted and the resilient member 128 is compressed. When the oblique guiding portion 1300 of the first linking sleeve 130 moves over the protruding portion 1222 of the rotating member 122, the twisted torsion spring 124 generates a torsion force for driving the rotating member 122 to rotate in a second direction D2, such that the oblique guiding portion 1300 abuts against the protruding portion 1222, as shown in FIG. 11. The aforesaid first direction D1 is opposite to the second direction D2. Accordingly, the stylus 3 can be accommodated in the stylus storage mechanism 12 stably. Therefore, the stylus 3 will not come off the stylus storage mechanism 12 easily due to collision.

When the user wants to take the stylus 3 out, he/she only has to rotate the operating portion 1220 of the rotating member 122 in the first direction D1. When the operating portion 1220 is rotated to drive the rotating member 122 to rotate in the first direction D1 and then the protruding portion 1222 is separated from the oblique guiding portion 1300, the compressed resilient member 128 generates an elastic force for pushing the sleeve assembly 126 to move away from the rotating member 122, so as to eject the stylus 3 out of the accommodating space 1200 from the second end 1204 of the casing 120. Accordingly, the user can take the stylus 3 out of the stylus storage mechanism 12 conveniently.

As shown in FIGS. 2 and 3, the casing 120 further has a first stop portion 1208 and the rotating member 122 further has a second stop portion 1224. The first stop portion 1208 cooperates with the second stop portion 1224 to allow the rotating member 122 to rotate in the first direction D1 only when the stylus 3 is accommodated in the accommodating space 1200 of the casing 120, so as to prevent the stylus storage mechanism 12 from being damaged or failing due to mis-operation.

As mentioned in the above, when a user wants to store the stylus in the stylus storage mechanism, he/she can insert the stylus into the accommodating space of the casing and push the stylus to move toward the rotating member. At this time, an end of the stylus is fixed in the fixing hole of the sleeve assembly and the protruding portion on the rotating member cooperates with the oblique guiding portion in the sleeve assembly, such that the stylus can be accommodated in the stylus storage mechanism of the invention stably. Therefore, the stylus will not come off the stylus storage mechanism easily due to collision. Furthermore, when the user wants to take the stylus out, he/she only has to rotate the operating portion of the rotating member to separate the protruding portion on the rotating member from the oblique guiding portion in the sleeve assembly. Afterward, the resilient member generates an elastic force for pushing the sleeve assembly to move away from the rotating member, so as to eject the stylus out of the accommodating space of the casing. Accordingly, the user can take the stylus out of the stylus storage mechanism of the invention conveniently. Moreover, if the electronic device has a handle, the stylus storage mechanism of the invention may be disposed in the handle, so it will not occupy any space within a case body of the main device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A stylus storage mechanism comprising:

a casing having an accommodating space, a first end and a second end, the first end being opposite to the second end, the first end communicating with the second end via the accommodating space;

a rotating member having an operating portion and a protruding portion, an end of the rotating member being inserted into the accommodating space from the first end, the operating portion being exposed out of the first end, the protruding portion being located in the accommodating space;

a torsion spring disposed in the accommodating space, opposite ends of the torsion spring being connected to the rotating member and the casing;

a sleeve assembly disposed in the accommodating space, the sleeve assembly having an oblique guiding portion and a fixing hole, the oblique guiding portion corresponding to the protruding portion; and a resilient member disposed between the sleeve assembly and the rotating member;

wherein when a stylus is inserted into the accommodating space from the second end and pushes the sleeve assembly to move toward the rotating member, an end of the stylus is fixed in the fixing hole and the oblique guiding portion pushes the protruding portion, such that the rotating member rotates in a first direction; when the oblique guiding portion moves over the protruding portion, the torsion spring generates a torsion force for driving the rotating member to rotate in a second direction, such that the oblique guiding portion abuts against the protruding portion, the first direction is opposite to the second direction; when the operating portion is rotated to drive the rotating member to rotate in the first direction and then the protruding portion is separated from the oblique guiding portion, the resilient member generates an elastic force for pushing the sleeve assembly to move away from the rotating member, so as to eject the stylus out of the accommodating space from the second end.

2. The stylus storage mechanism of claim 1, wherein the sleeve assembly comprises a first linking sleeve, a second linking sleeve and a fixing sleeve, the second linking sleeve is fixed on the first linking sleeve, the fixing sleeve is fixed on the second linking sleeve, the oblique guiding portion is formed in the first linking sleeve, and the fixing hole is formed on the fixing sleeve.

3. The stylus storage mechanism of claim 2, wherein the second linking sleeve has a pillar portion, the pillar portion is extended into the first linking sleeve, and the resilient member is sleeved on the pillar portion.

4. The stylus storage mechanism of claim 2, wherein the fixing sleeve is made of rubber.

5. The stylus storage mechanism of claim 2, wherein the first linking sleeve has an engaging hole, the second linking sleeve has an engaging hook, and the engaging hook is engaged in the engaging hole.

6. The stylus storage mechanism of claim 2, wherein the first linking sleeve has a restraining portion, a restraining groove is formed in the accommodating space, and the restraining portion is located in the restraining groove, so as to restrain the sleeve assembly from rotating with respect to the casing.

7. The stylus storage mechanism of claim 2, wherein the fixing sleeve has a plurality of protruding blocks protruding from a periphery of the fixing hole inwardly and used for fixing the end of the stylus in the fixing hole in a tight-fitting manner.

8. The stylus storage mechanism of claim 1, wherein the casing has a first stop portion, the rotating member has a second stop portion, and the first stop portion cooperates with the second stop portion to allow the rotating member to rotate in the first direction only when the stylus is accommodated in the accommodating space.

9. An electronic device comprising:

a main device; and a stylus storage mechanism disposed in a part of the main device, the stylus storage mechanism comprising:

a casing having an accommodating space, a first end and a second end, the first end being opposite to the second end, the first end communicating with the second end via the accommodating space;

a rotating member having an operating portion and a protruding portion, an end of the rotating member being inserted into the accommodating space from the first end, the operating portion being exposed out of the first end, the protruding portion being located in the accommodating space;

a torsion spring disposed in the accommodating space, opposite ends of the torsion spring being connected to the rotating member and the casing;

a sleeve assembly disposed in the accommodating space, the sleeve assembly having an oblique guiding portion and a fixing hole, the oblique guiding portion corresponding to the protruding portion; and a resilient member disposed between the sleeve assembly and the rotating member;

wherein when a stylus is inserted into the accommodating space from the second end and pushes the sleeve assembly to move toward the rotating member, an end of the stylus is fixed in the fixing hole and the oblique guiding portion pushes the protruding portion, such that the rotating member rotates in a first direction; when the oblique guiding portion moves over the protruding portion, the torsion spring generates a torsion force for driving the rotating member to rotate in a second direction, such that the oblique guiding portion abuts against the protruding portion, the first direction is opposite to the second direction; when the operating portion is rotated to drive the rotating member to rotate in the first direction and then the protruding portion is separated from the oblique guiding portion, the resilient member generates an elastic force for pushing the sleeve assembly to move away from the rotating member, so as to eject the stylus out of the accommodating space from the second end.

10. The electronic device of claim 9, wherein the part is a handle.

11. The electronic device of claim 9, wherein the sleeve assembly comprises a first linking sleeve, a second linking sleeve and a fixing sleeve, the second linking sleeve is fixed on the first linking sleeve, the fixing sleeve is fixed on the second linking sleeve, the oblique guiding portion is formed in the first linking sleeve, and the fixing hole is formed on the fixing sleeve.

12. The electronic device of claim 11, wherein the second linking sleeve has a pillar portion, the pillar portion is extended into the first linking sleeve, and the resilient member is sleeved on the pillar portion.

13. The electronic device of claim 11, wherein the fixing sleeve is made of rubber.

14. The electronic device of claim 11, wherein the first linking sleeve has an engaging hole, the second linking sleeve has an engaging hook, and the engaging hook is engaged in the engaging hole.

15. The electronic device of claim 11, wherein the first linking sleeve has a restraining portion, a restraining groove is formed in the accommodating space, and the restraining portion is located in the restraining groove, so as to restrain the sleeve assembly from rotating with respect to the casing.

16. The electronic device of claim 11, wherein the fixing sleeve has a plurality of protruding blocks protruding from a periphery of the fixing hole inwardly and used for fixing the end of the stylus in the fixing hole in a tight-fitting manner.

17. The electronic device of claim 9, wherein the casing has a first stop portion, the rotating member has a second stop portion, and the first stop portion cooperates with the second stop portion to allow the rotating member to rotate in the first direction only when the stylus is accommodated in the accommodating space.

* * * * *